US006152794A

United States Patent [19]

Liu

[11] Patent Number: 6,152,794

[45] Date of Patent: Nov. 28, 2000

[54] SWIM FIN

[76] Inventor: Yen-Wei Liu, 10/F, No. 135-1 Chung-Shan Rd., San Chorng City, Taipei Hsien, Taiwan

[21] Appl. No.: 09/312,042

[22] Filed: May 14, 1999

[51] Int. Cl.[7] ..... A63B 31/11

[52] U.S. Cl. ..... 441/64

[58] Field of Search ..... 441/64, 61

[56] References Cited

U.S. PATENT DOCUMENTS 4,838,824 6/1989 McCredie ..... 441/64

FOREIGN PATENT DOCUMENTS 1.238.370 7/1960 France ..... 441/64

2.115.724 7/1972 France ..... 441/64

2 550 456 2/1985 France ..... 441/64

*Primary Examiner*—Sherman Basinger

*Attorney, Agent, or Firm*—Pro-Techtor International Services

[57] ABSTRACT

A swim fin molded from flexible material such as rubber or plastics, having a foot pocket and a blade formed integral with the foot pocket, wherein the foot pocket has a sloping upper face and a slopping sole respectively sloping from the heel thereof toward the blade; the blade forwardly extends from front and two opposite lateral sides of the foot pocket and terminates in a forked end, having a thin middle portion, two thick side portions at two opposite lateral sides of the thin middle portion, two side rails respectively formed integral with the thick side portions at an outer side, and a plurality of ribs respectively formed at top and bottom side walls thereof.

4 Claims, 11 Drawing Sheets

SWIM FIN

BACKGROUND OF THE INVENTION

The present invention relates to a swim fin, and more particularly to such a swim fin which produces less resistance, and improves propelling speed when oscillated in the water.

When oscillating the legs during swimming or skin diving, the swim fins which are fastened to the feet are oscillated against the water, causing a reactive force to be produced to push to the body forwards. FIGS. 1 and 2 show a swim fin according to the prior art. This structure of swim fin 1 comprises a foot pocket 11, and a blade 12 formed integral with the foot pocket 11. The sole 111 of the foot pocket 11 and the bottom side wall 121 of the blade 12 define a 130°~150° contained angle 10. Within this contained angle 10, ribs 13 are provided. When the swim fin 1 is fastened to the foot, the contained angle 101 defined between the axis longitudinally extended from the back of the user's body and the sole 111 of the foot pocket 11 exceeds 180° angle. When the swim fin 1 is turned backwards in the water, a reactive force is produced and employed to the swim fin 1, causing the user to be pushed forwards. However, because the sole 111 of the foot pocket 11 and the bottom side wall 121 of the blade 12 define a 130°~150° contained angle 10, the contained angle 102 defined between the axis longitudinally extended from the back of the user's body and the bottom side wall 121 of the blade 12 is smaller than 180° angle, a reactive force is given from the water to the bottom side wall 121 of the blade 12 against forward movement of the body. When the user turns the foot forwards, the upper face 112 of the foot pocket 11 and the axis which is longitudinally extended from the front side of the user's body define a contained angle 103 over 180° angle, and a reactive force is given to the foot to push the user forwards. At the same time, the top side wall 122 of the blade 12 which extends longitudinally from the upper face 112 of the foot pocket 11 receives the same reactive force to push the user forwards.

FIGS. 4 and 5 show another structure of swim fin 5 according to the prior art. According to this structure of swim fin 5, the top side wall 521 of the blade 52 is formed integral with the upper face 511 of the foot pocket 51, the elevation of the sole 512 of the foot pocket 51 is lower than the rear portion of the bottom side wall 522 of the blade 52, and ribs 53 are provided between the rear portion of the bottom side wall 522 of the blade 52 and the front end edge 512*a* of the sole 512 of the foot pocket 51. The front portion of the bottom side wall 522 of the blade 52 and the sole 512 are disposed at same elevation. As illustrated in FIG. 6, when the user turns the foot backwards, the sole 512 of the foot pocket 51 and the back side of the user's body are disposed at approximately same elevation, and a reactive force is given from the water to the sole 512 of the foot pocket 51 in direction about perpendicular to the user's body. Because the direction of the reactive force is about perpendicular to the user's body, it cannot push the user forwards. As indicated above, the contained angle which is defined between the axis longitudinally extended from the back of the user's body, the sole 111 or 512 of the foot pocket 11 or 51, the bottom side wall 121 or 522 of the blade 12 or 52, the upper face 511 or 112 of the foot pocket 51 or 11, or the top side wall 521 or 122 of the blade 52 or 12, has a great concern with the effect of the reactive force which is given from the water to the sole 512 or 111 of the foot pocket 51 or 11, the bottom side wall 522 or 121 of the blade 52 or 12, the upper face 511 or 112 of the foot pocket 51 or 11, the top side wall 521 or 122 of the blade 52 or 12.

SUMMARY OF THE INVENTION

The present invention has been accomplished to provide a swim fin which eliminates the drawbacks of the aforesaid prior art swim fins. According to one aspect of the present invention, the swim fin is made from flexible rubber or plastics, comprising a foot pocket and a blade formed integral with the foot pocket, wherein the foot pocket has a conical profile; the blade forwardly extends from front and two opposite lateral sides of the foot pocket and terminates in a forked end, having a thin middle portion, two thick side portions at two opposite lateral sides of the thin middle portion, two side rails respectively formed integral with the thick side portions at an outer side, and a plurality of ribs respectively formed at top and bottom side walls thereof. Because the blade has a thin middle portion, two thick side portions at two opposite lateral sides of the thin middle portion, and two side rails respectively formed integral with the thick side portions at an outer side, the contained angle defined between the axis longitudinally extended from the front side of the body and the sole of the foot pocket or bottom side wall of the blade as well as the contained angle defined between the axis longitudinally extended from the back side of the body and the upper face of the foot pocket or top side wall of the blade exceed 180° angle, and the reactive force which is produced from the water against the swim fin is effectively used to push the user forwards. According to another aspect of the present invention, the foot pocket comprises a sloping upper face and a slopping sole respectively sloping from a heel thereof toward the blade, and terminating in a toe-end, which is formed integral with the blade. Therefore, less resisting force is produced to hinder forward movement of the body.

DETAILED DESCRIPTION OF THE PREFERRED EMBODIMENT

Figure 1:
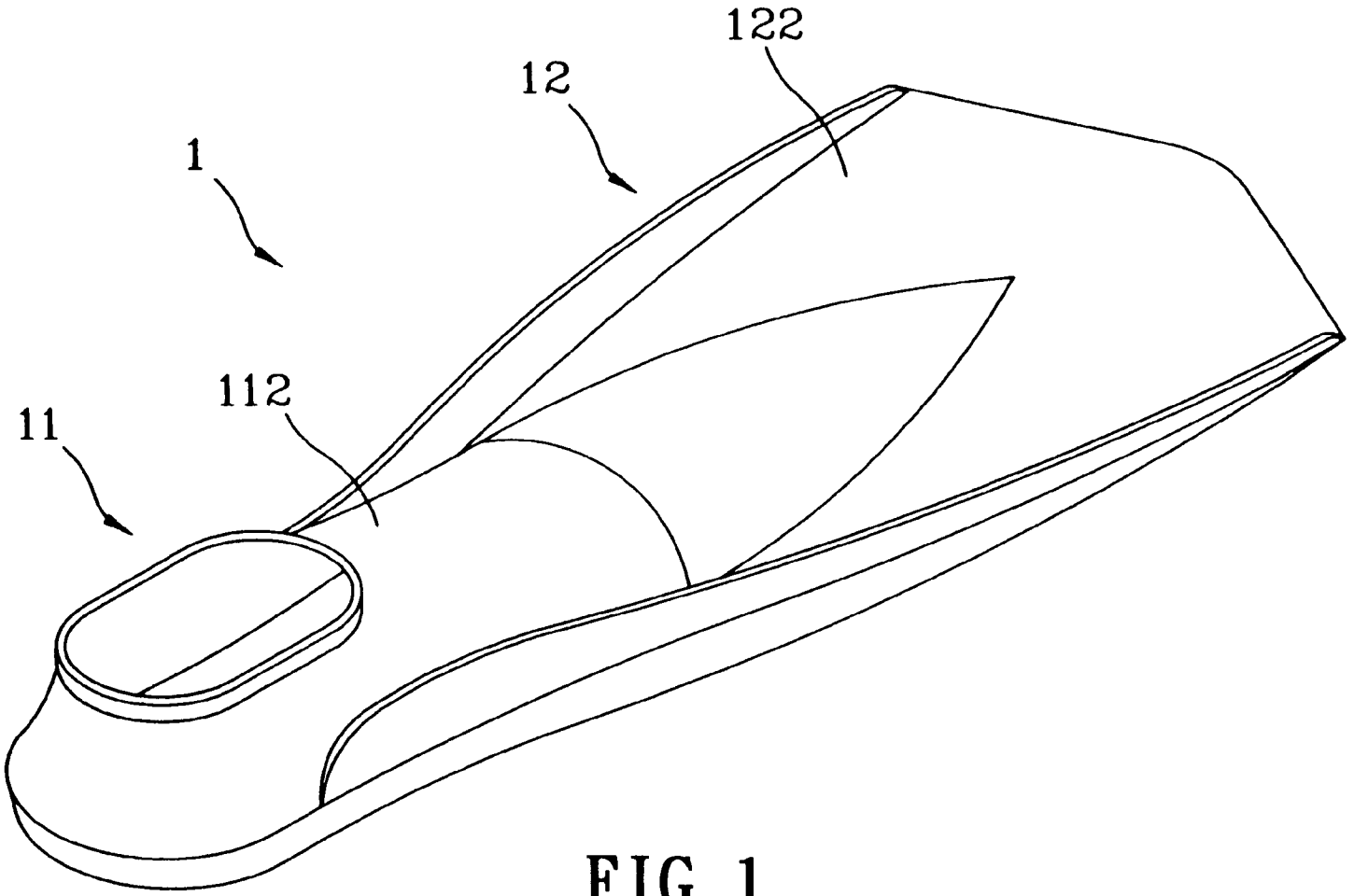
FIG. 1 (PRIOR ART)
FIG. 1 is an oblique front view of a swim fin according to the prior art.
Figure 2:
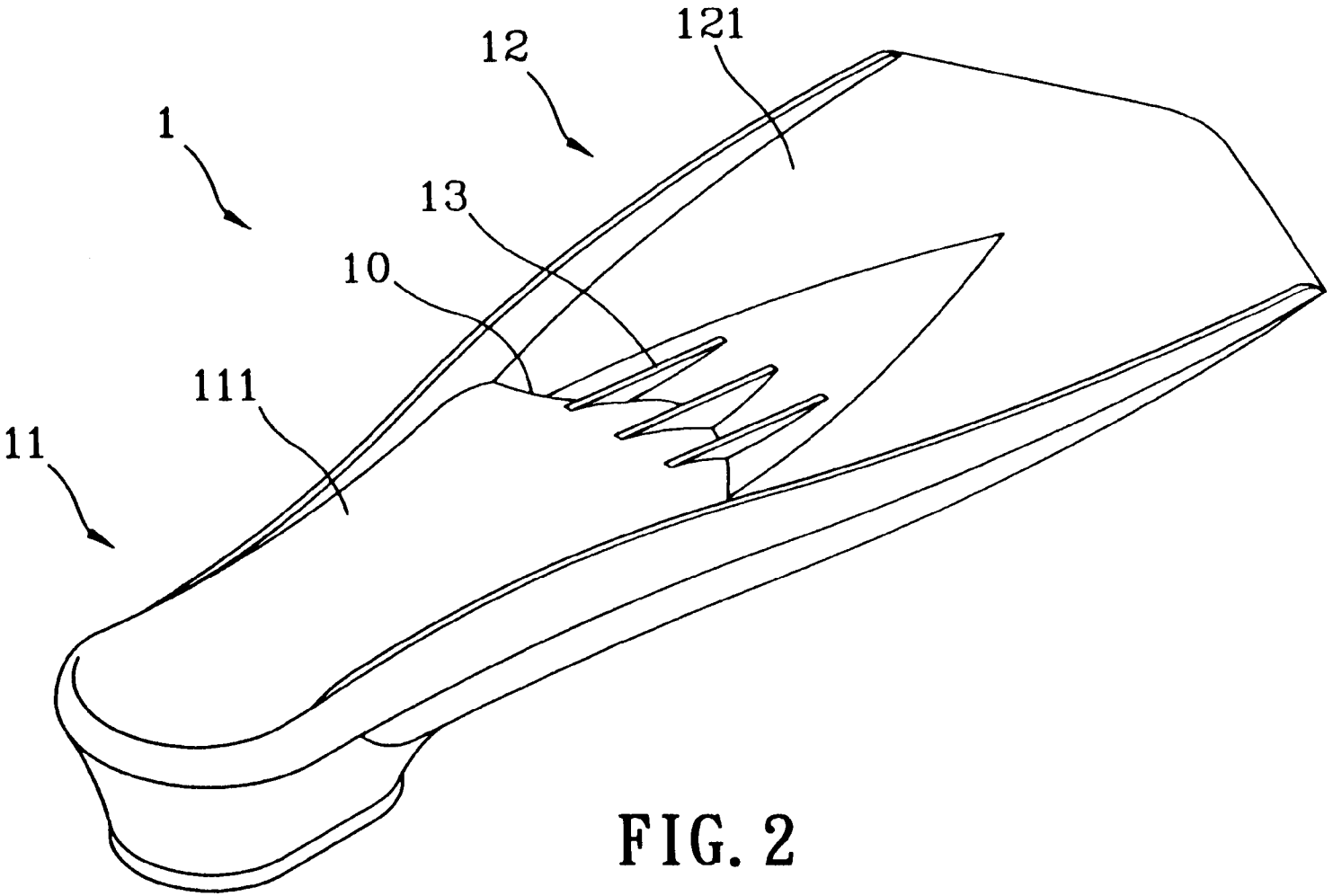
FIG. 2 (PRIOR ART)
FIG. 2 is an oblique bottom side view of the swim fin shown in FIG. 1.
Figure 3:
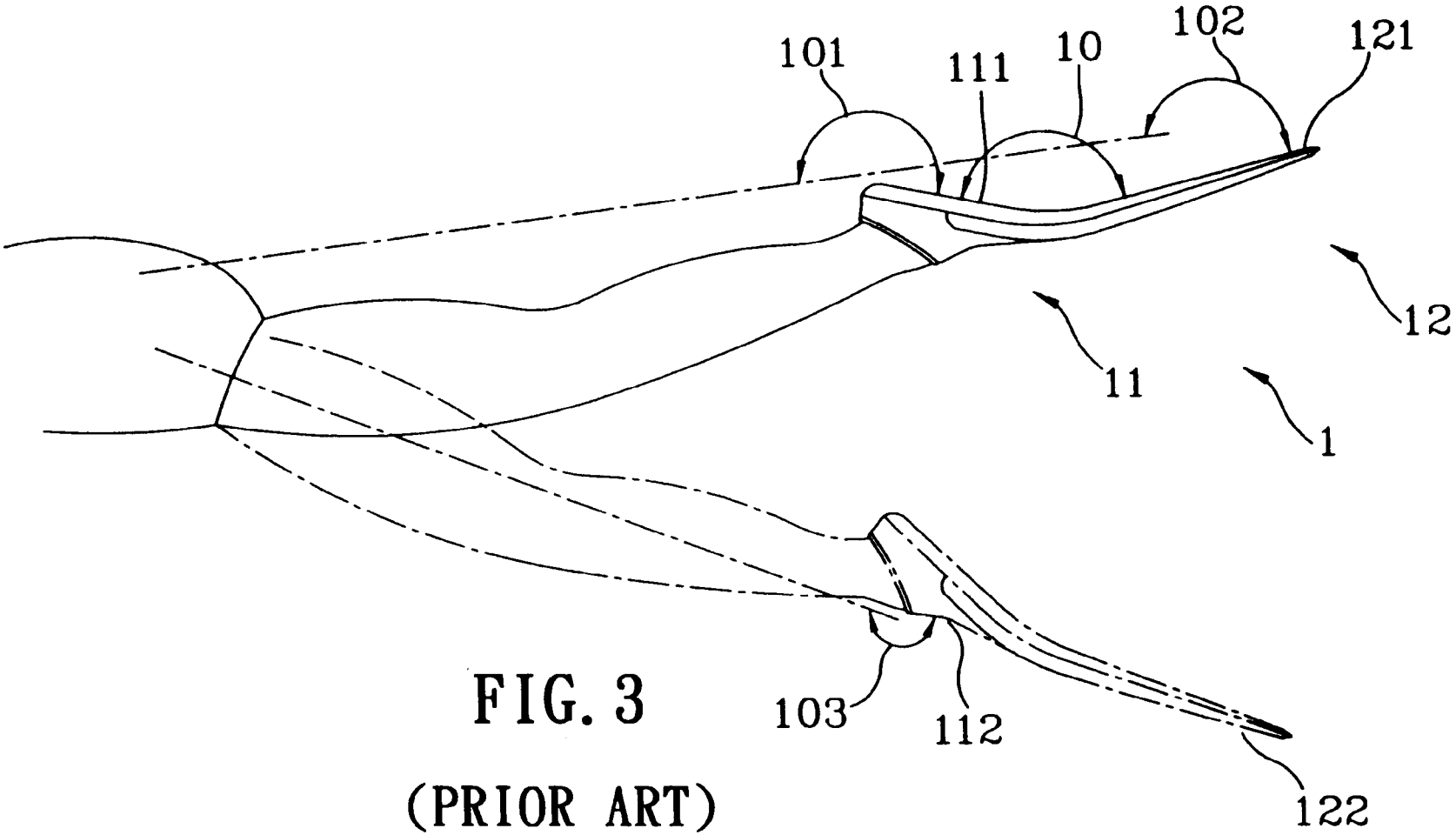
FIG. 3 (PRIOR ART)
FIG. 3 is schematic drawing showing the work of the prior art swim fin shown in FIGS. 1 and 2 when oscillated in the water.
Figure 4:
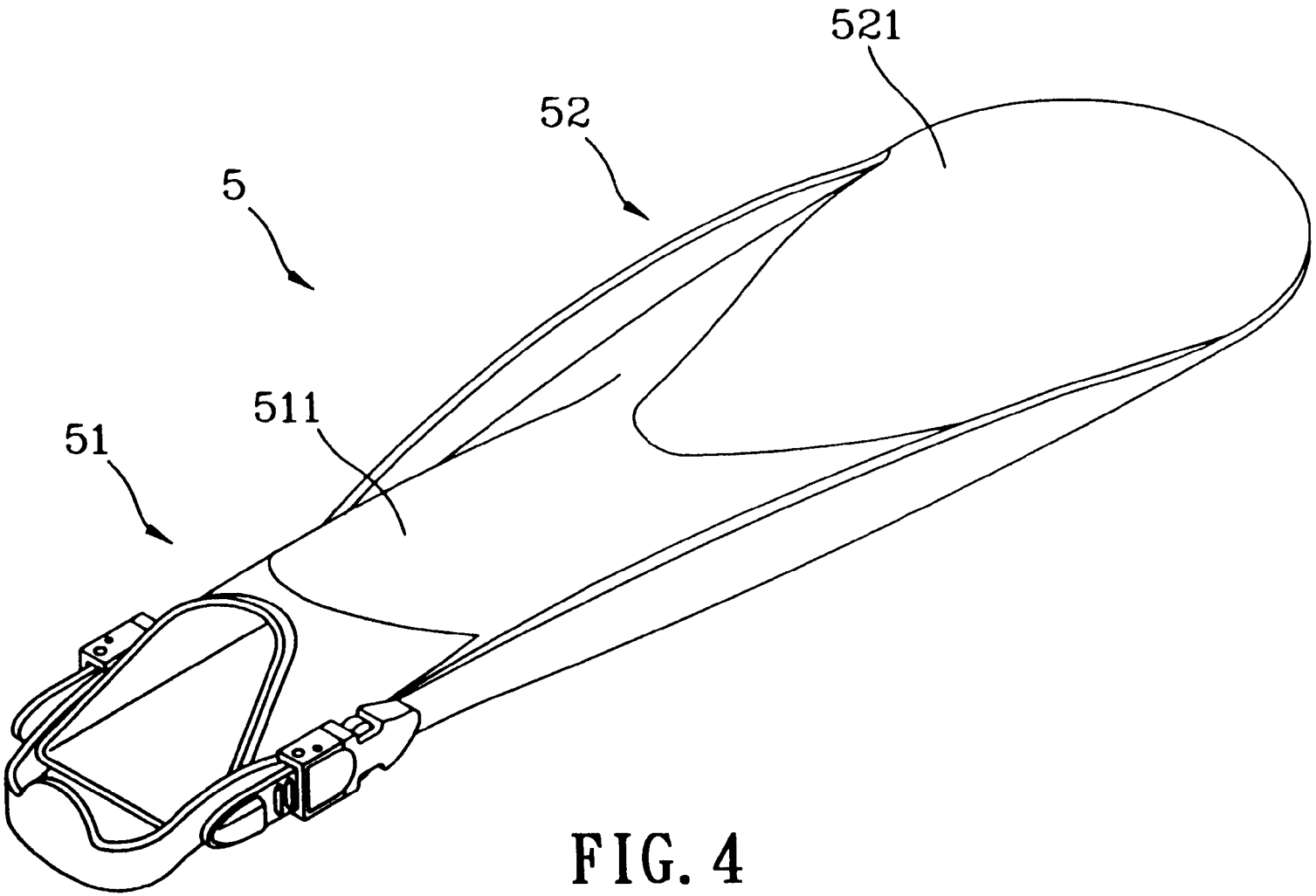
FIG. 4 (PRIOR ART)
FIG. 4 is an oblique front view of another structure of swim fin according to the prior art.
Figure 5:
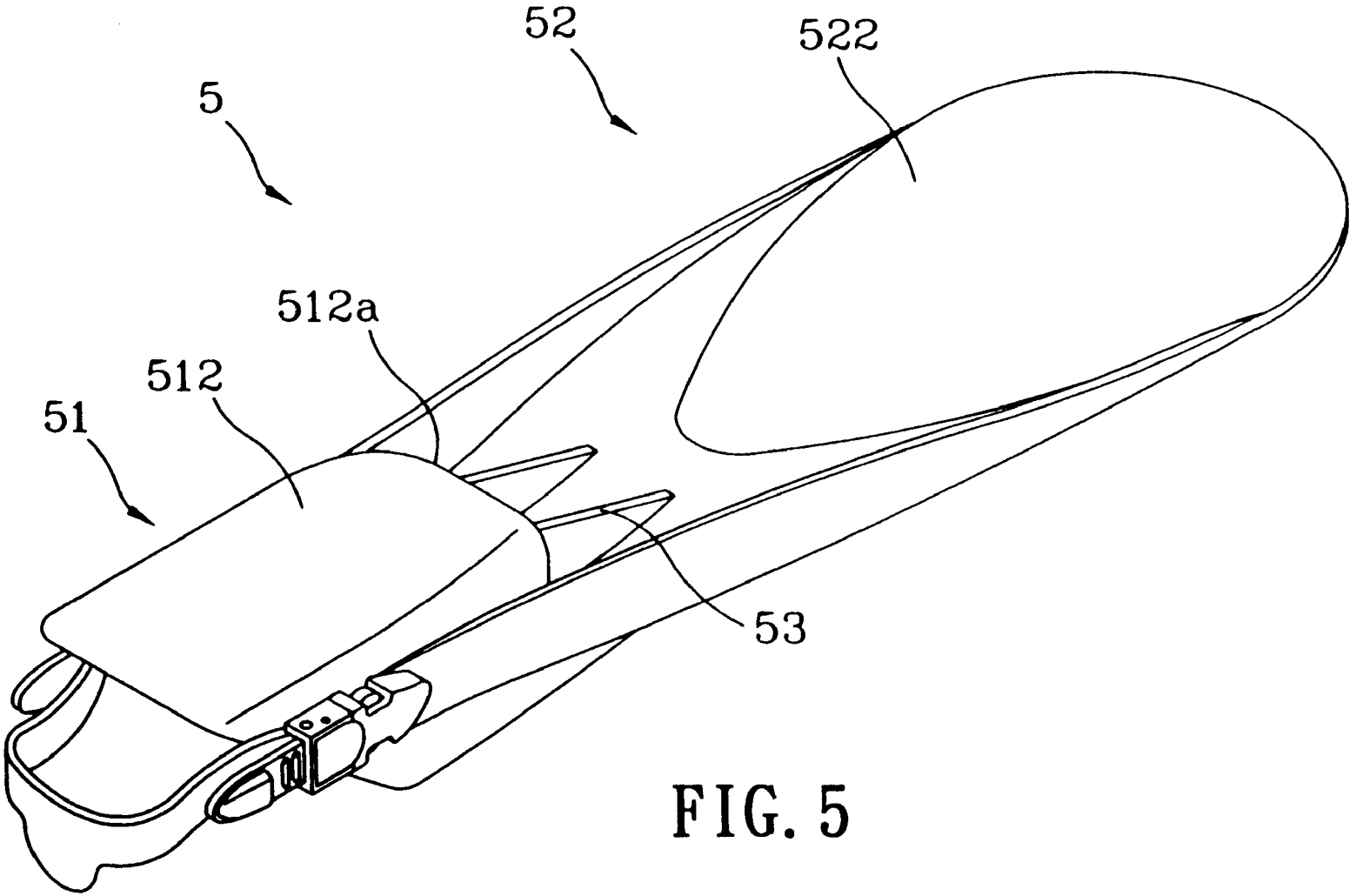
FIG. 5 (PRIOR ART)
FIG. 5 is an oblique bottom side view of the swim fin shown in FIG. 4.
Figure 6:
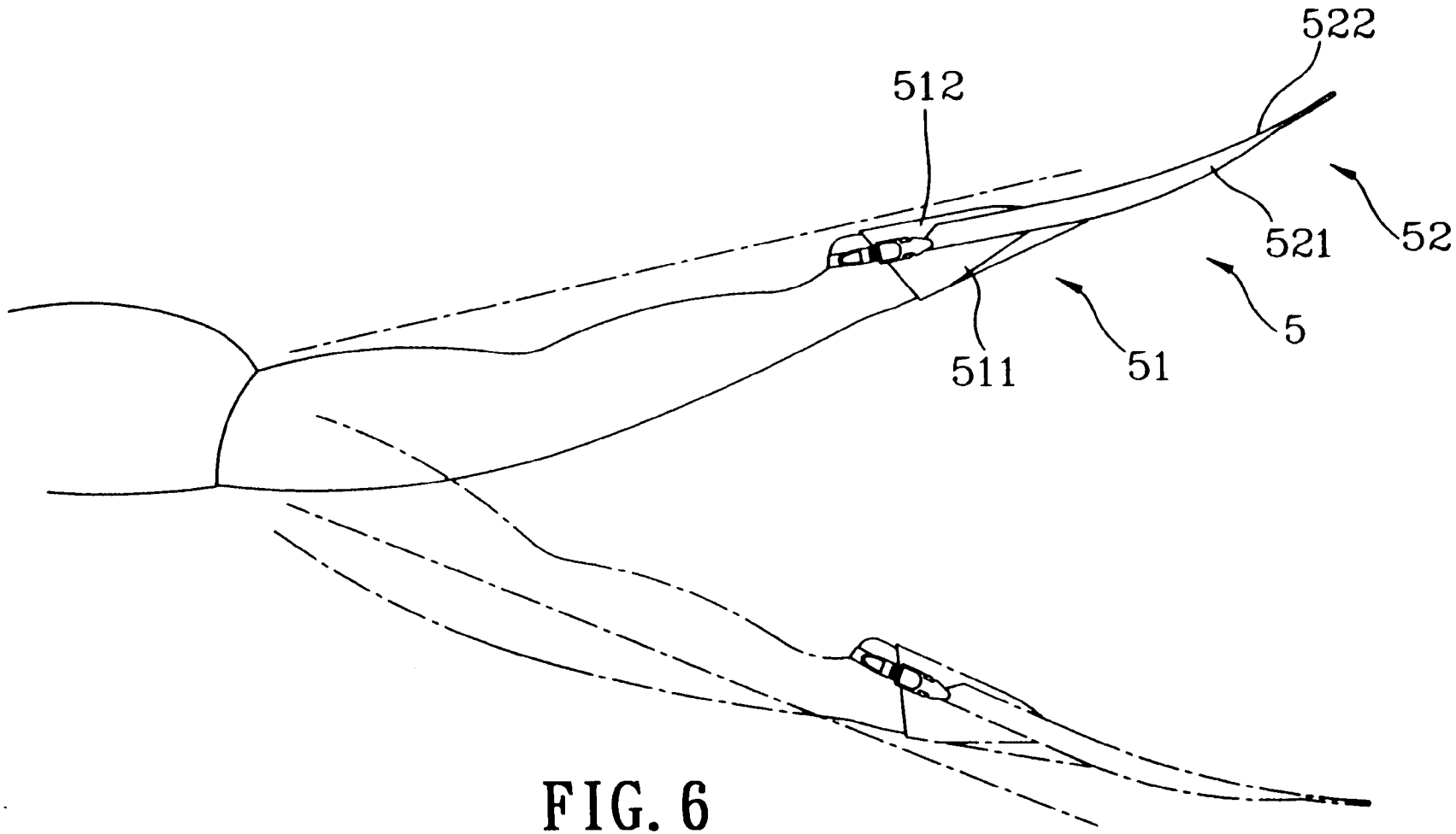
FIG. 6 (PRIOR ART)
FIG. 6 is schematic drawing showing the work of the prior art swim fin shown in FIG. 5 when oscillated in the water.
Figure 7:
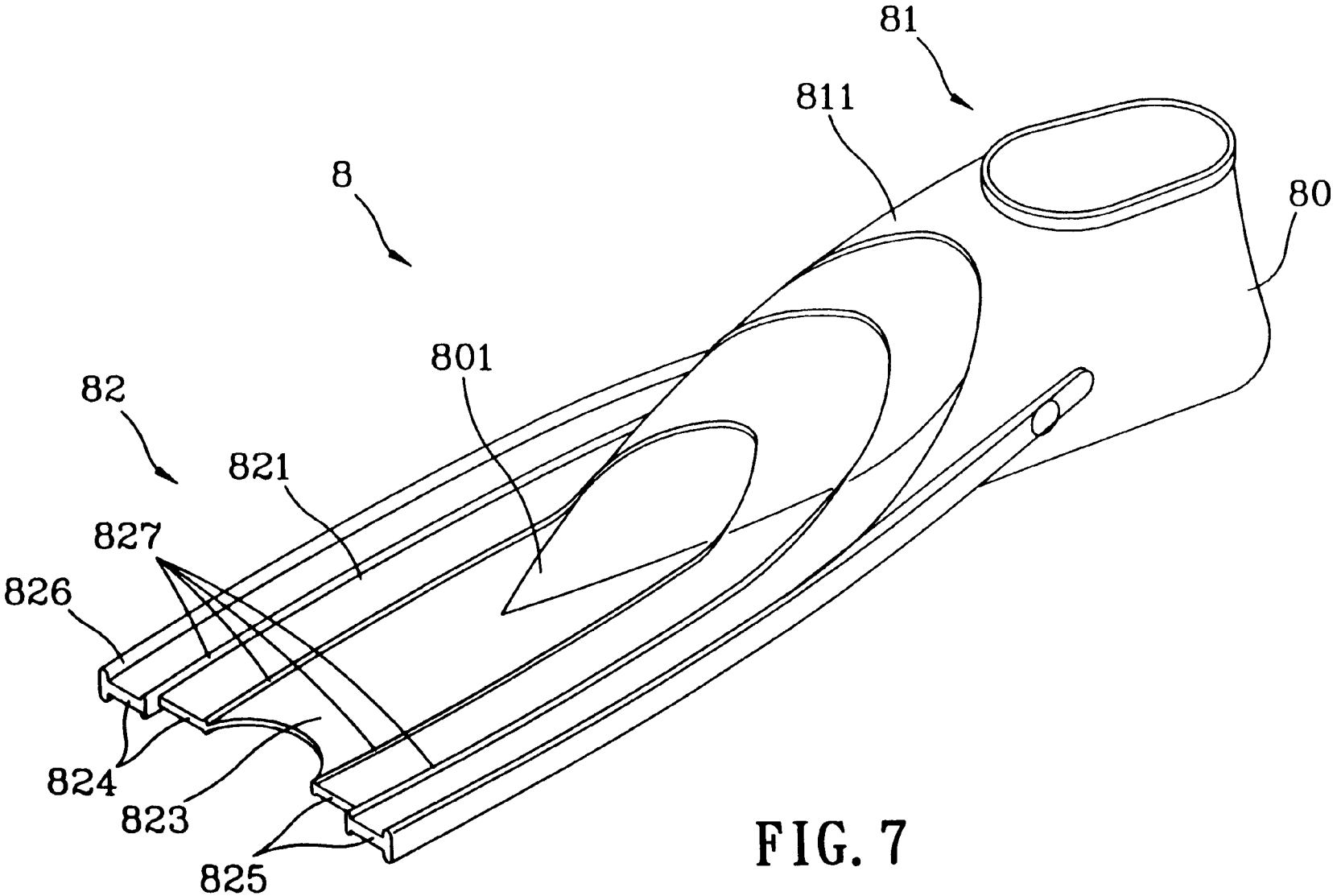
FIG. 7 is an oblique front view of a swim fin according to the present invention.
Figure 8:
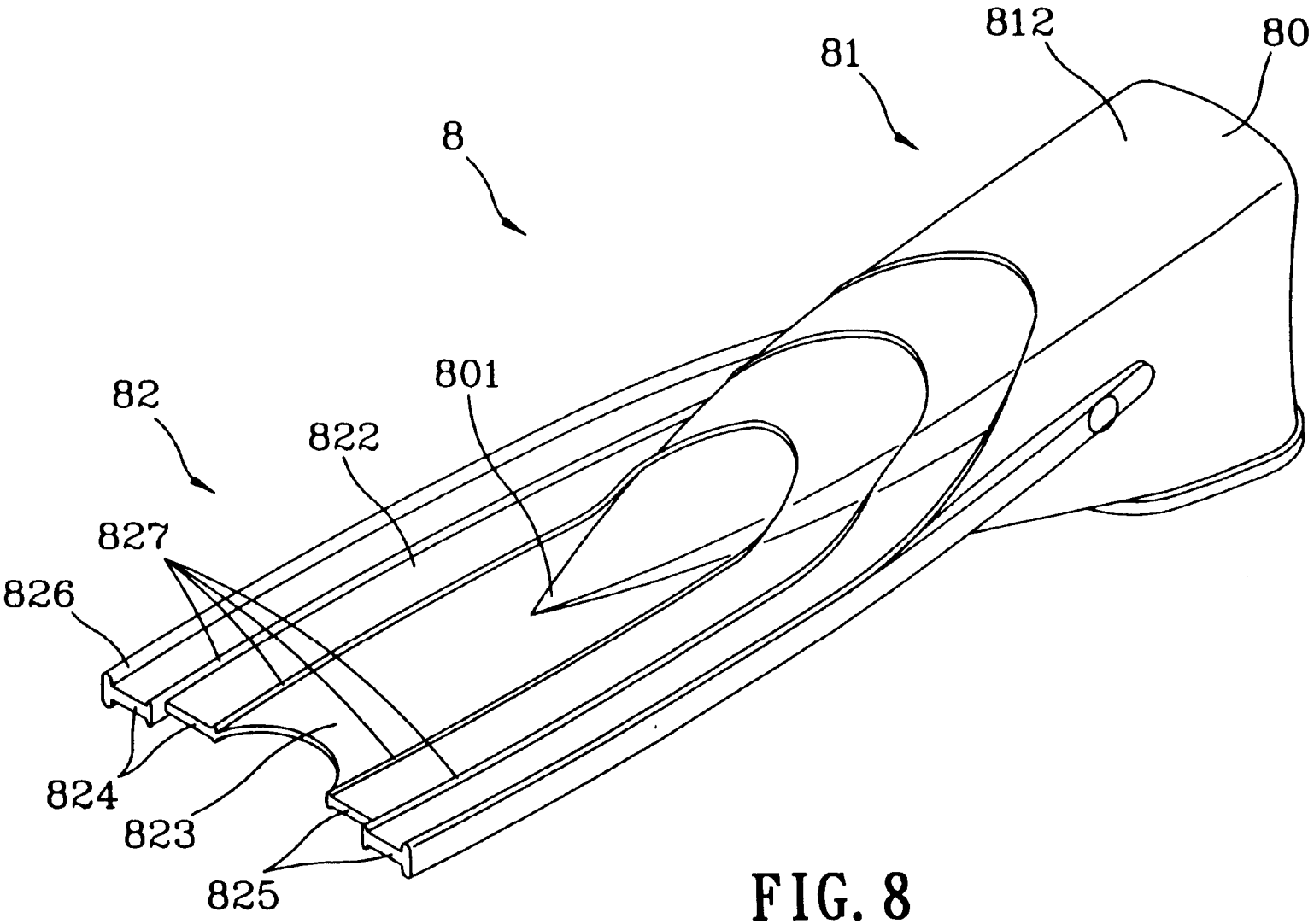
FIG. 8 is an oblique bottom side view of the swim fin shown in FIG. 7.

Referring to FIGS. 7 and 8, a swim fin (flipper) 8 in accordance with the present invention comprises a foot pocket 81 and a blade 82 formed integral with the foot pocket 81. The foot pocket 81 comprises a sloping upper face 811 and a slopping sole 812 respectively sloping from the heel 80 thereof toward the blade 82, and terminating in a toe-end 801, which is formed integral with the blade 82. Therefore, the foot pocket 81 has a conical profile. The blade 82 forwardly extends from the front and two opposite lateral sides of the foot pocket 81 and terminates in a forked end, having an upper side wall 821 and a bottom side wall 822. The upper side wall 821 and the bottom side wall 822 are symmetrical. The blade 82 has a thin middle, portion 823, and thick side portions 824 and 825 at two opposite lateral sides of the thin middle portion 823. Two side rails 826 are respectively formed integral with the thick side portions 824 and 825 at an outer side. Ribs 827 are respectively formed at the upper side wall 821 and bottom side wall 822 of the blade 82 to reinforce the structural strength of the swim fin 8.

Figure 9:
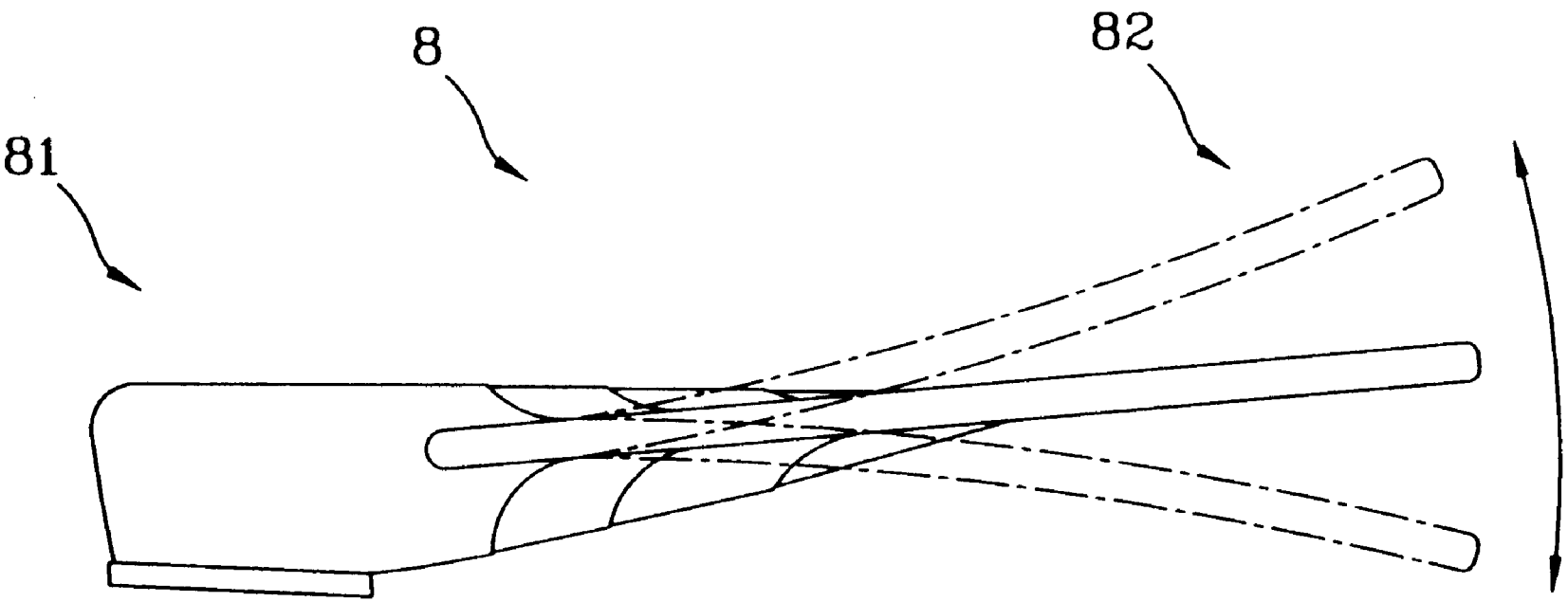
FIG. 9 is a schematic drawing showing the swim fin oscillated in the water according to the present invention.

Referring to FIG. 9 and FIGS. 7 and 8 again, the swim fin 8 can be molded from rubber or plastics, and is flexible. Because the swim fin 8 is flexible, it deforms like the tail fin of a fish when oscillated in the water, and a reactive force is positively given from the water to the swim fin 8, causing the user to be pushed forwards.

Figure 10:
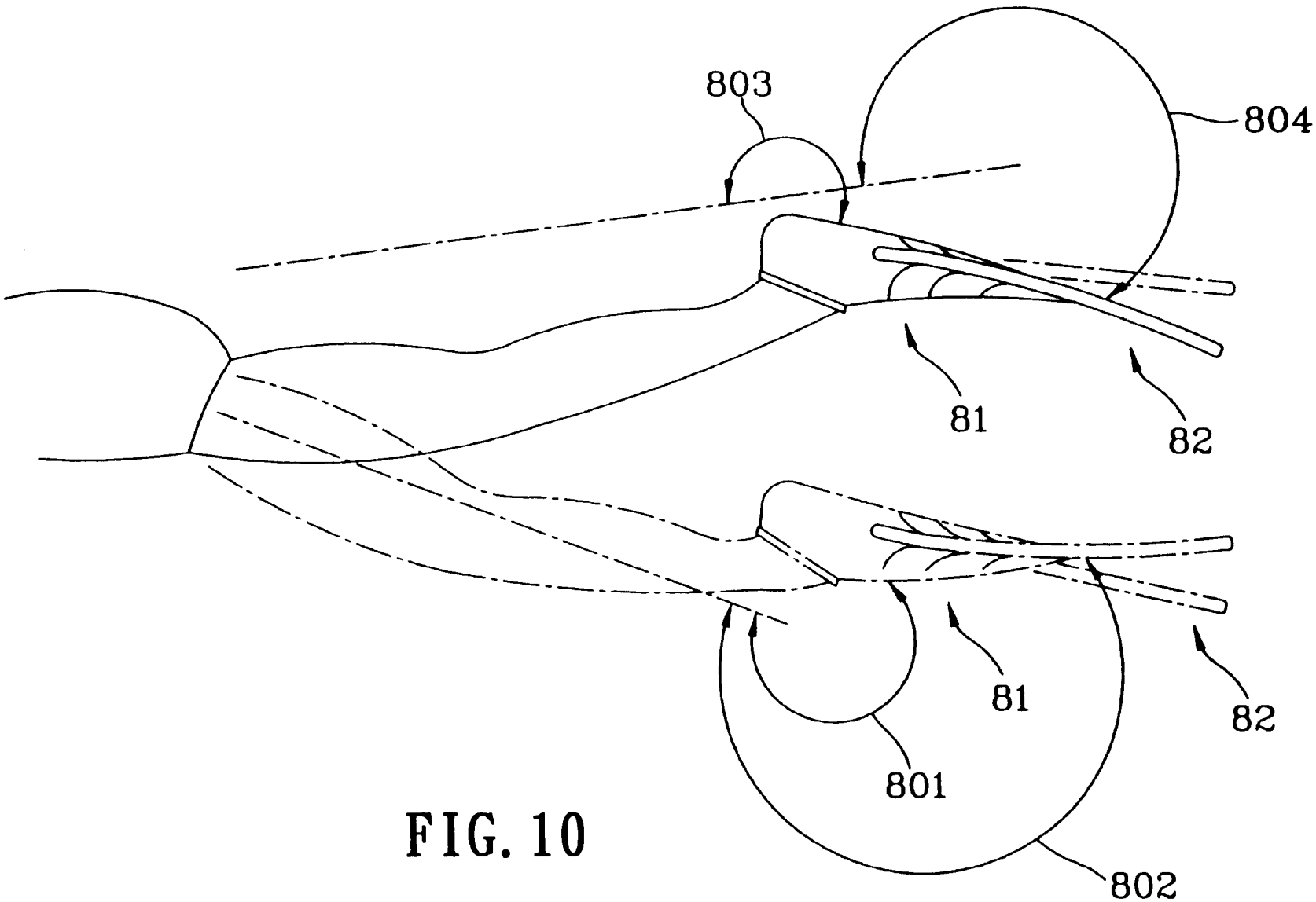
FIG. 10 is schematic drawing showing the work of the present invention when oscillated in the water.

Referring to FIG. 10, when the blade 82 is turned forwards and forced to deform by water pressure during swimming, the contained angle 801 defined between the user's body and the sloping upper face 811 of the foot pocket 81 as well as the contained angle 802 defined between the axis longitudinally extended from the front side of the user's body and the upper side wall 821 of the blade 82 are over 180° angle. When the blade 82 is turned backwards, the contained angle 803 defined between the user's body and the sole 812 of the foot pocket 81 as well as the contained angle 804 defined between the axis longitudinally extended from the back side of the user's body and the bottom side wall 822 of the blade 82 are over 180° angle. As indicated above, when the swim fin 8 is turned forwards during swimming, the sloping upper face 811 of the foot pocket 81 and the upper side wall 821 of the blade 82 bear a pressure from the water in same direction, therefore no reactive force is neutralized. When the swim fin 8 is turned backwards, the sole 812 of the foot pocket 81 and the bottom side wall 822 of the blade 82 bear a pressure from the water in same direction, therefore no reactive force is neutralized, and an accelerated push force is given to the swim fin 8 to push the user forwards in the water.

Figure 11:
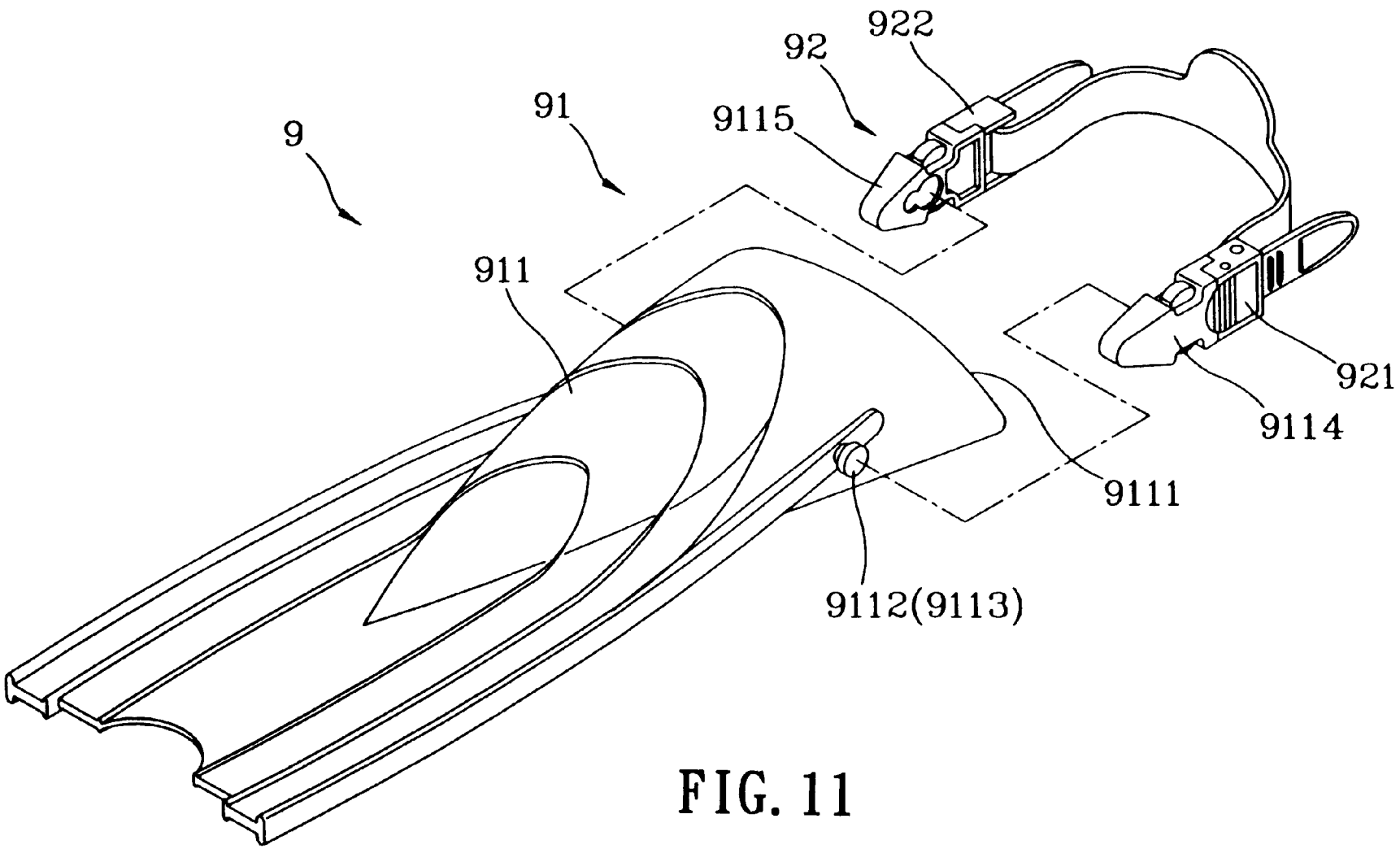
FIG. 11 is an exploded view of an alternate form of the swim fin according to the present invention.

FIG. 11 shows an alternate form of the present invention. According to this alternate form, the foot pocket 91 of the swim fin 9 is comprised of a body 911, and a heel strap 92 for fastening to the body 911 to secure the swim fin 9 to the user's foot. The body 911 comprises a rear open side 9111 for receiving the foot, two retainer rods 9112 and 9113 respectively raised from two opposite lateral sides thereof, and two female connectors 9114 and 9115 respectively fastened to the retainer rods 9112 and 9113. The heel strap 92 comprises two male connectors 921 and 922 at its two opposite ends for fastening to the female connectors 9114 and 9115 at the retainer rods 9112 and 9113 respectively. The male connector 921 or 922 and the female connector 9114 or 9115 form a quick-release hook. Therefore, the heel strap 92 can easily detachably fastened to the body 911.

It is to be understood that the drawings are designed for purposes of illustration only, and are not intended as a definition of the limits and scope of the invention disclosed.

What the invention claimed is:

1. A swim fin comprising:

a foot pocket and a blade formed integrally with said foot pocket, said foot pocket has a conical profile;

said blade extends forward from a front and two opposite lateral sides of said foot pocket and terminates in a forked end having a thin middle portion, two thick side portions at two opposite lateral sides of said thin middle portion, two side rails formed integrally with said thick side portions at an outer side, and a plurality of ribs formed at top and bottom sides thereof.

2. The swim fin of claim 1 wherein said foot pocket comprises an upper face and a sole, said upper face and said sole slope from a heel of said foot pocket toward said blade and terminating in a toe-end, said foot pocket is formed integrally with said blade.

3. The swim fin of claim 1 wherein said foot pocket and said blade are integrally molded from flexible rubber.

4. The swim fin of claim 1 wherein said foot pocket and said blade are integrally molded from flexible plastics.

* * * * *